US009188417B2

(12) United States Patent
Geswender et al.

(10) Patent No.: US 9,188,417 B2
(45) Date of Patent: Nov. 17, 2015

(54) SEPARABLE SABOT FOR LAUNCHING PAYLOAD

(71) Applicant: Raytheon Company, Waltham, MA (US)

(72) Inventors: Chris E. Geswender, Green Vally, AZ (US); Mark A. Scott, Corona, AZ (US); James D. Streeter, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 167 days.

(21) Appl. No.: 13/956,793

(22) Filed: Aug. 1, 2013

(65) Prior Publication Data

US 2015/0300796 A1 Oct. 22, 2015

(51) Int. Cl.
*F42B 14/06* (2006.01)

(52) U.S. Cl.
CPC ..... *F42B 14/06* (2013.01)

(58) Field of Classification Search
CPC ..... F42B 12/58; F42B 12/62; F42B 12/625; F42B 14/06; F42B 14/061; F42B 14/064; F42B 14/065; F42B 14/067; F42B 14/068; F42B 14/08
USPC ..... 102/393, 489, 520, 521, 522, 523
See application file for complete search history.

(56) References Cited

U.S. PATENT DOCUMENTS 2,411,432 A * 11/1946 Imber ..... 102/393
3,712,229 A * 1/1973 Schock ..... 102/489
3,714,900 A * 2/1973 Feldmann ..... 102/522
3,927,618 A * 12/1975 Engel ..... 102/522
4,342,262 A * 8/1982 Romer et al. ..... 102/489
4,411,200 A * 10/1983 Brede et al. ..... 102/529
4,492,166 A * 1/1985 Purcell ..... 102/384
4,653,405 A 3/1987 Paine
4,676,136 A 6/1987 Kalin
4,693,166 A 9/1987 Pehker et al.
4,706,569 A 11/1987 Wallow et al.
4,719,860 A 1/1988 Ruffle et al.
4,730,561 A 3/1988 Schaake
4,735,148 A 4/1988 Holtzman et al.
4,757,766 A 7/1988 Ruffle et al.
4,765,248 A 8/1988 Kruse et al.

(Continued)

OTHER PUBLICATIONS

United States Statutory Invention Registration No. US H1999 H published Nov. 6, 2001.

(Continued)

*Primary Examiner* — Bret Hayes
(74) *Attorney, Agent, or Firm* — Renner, Otto, Boisselle & Sklar, LLP

(57) ABSTRACT

A sabot is used for enclosing a payload, such as a missile or projectile, during launch. The sabot includes a series of panels that are held together prior to launch by engagement with a cap having protrusions or delay pins that maintain the panels in a closed condition. When the launch is initiated, the cap begins to slide out of engagement with the panels. The cap is configured such that the disengagement does not occur immediately upon movement of the cap; instead the protrusions are sized to delay opening of the panels until the sabot and missile have cleared the launcher. Then the panels rotate outward and drop away from a base the sabot, for example using self-releasing hinges. The base of the sabot may be configured to disengage from the payload by introduction of pressurized gases into a space between the base and an aft end of the missile.

20 Claims, 3 Drawing Sheets

(56) References Cited

U.S. PATENT DOCUMENTS

| | | | | | |
|---|---|---|---|---|---|
| 4,815,682 | A | | 3/1989 | Feldmann et al. | |
| 4,860,661 | A | | 8/1989 | Bock et al. | |
| 4,901,620 | A | | 2/1990 | Kemeny | |
| 4,901,646 | A | | 2/1990 | Feldmann et al. | |
| 4,928,573 | A | | 5/1990 | Fansler et al. | |
| 4,939,997 | A | | 7/1990 | Hoffman | |
| 4,982,647 | A | | 1/1991 | Hertzberg et al. | |
| 5,020,437 | A | | 6/1991 | Rieger et al. | |
| H941 | H | * | 8/1991 | Wyluda | 102/522 |
| 5,078,051 | A | | 1/1992 | Amundson | |
| 5,097,743 | A | | 3/1992 | Hertzberg et al. | |
| 5,179,250 | A | | 1/1993 | Campoli | |
| 5,183,961 | A | | 2/1993 | Campoli et al. | |
| 5,198,616 | A | | 3/1993 | Anderson | |
| 5,265,540 | A | | 11/1993 | Ducros et al. | |
| 5,277,096 | A | | 1/1994 | Campoli et al. | |
| 5,277,120 | A | | 1/1994 | Campoli et al. | |
| 5,277,121 | A | | 1/1994 | Campoli et al. | |
| 5,297,492 | A | | 3/1994 | Buc | |
| 5,323,708 | A | | 6/1994 | Sigler | |
| 5,372,058 | A | | 12/1994 | Petrovich et al. | |
| 5,388,523 | A | | 2/1995 | Rossmann | |
| 5,413,049 | A | | 5/1995 | Feldmann et al. | |
| 5,493,974 | A | * | 2/1996 | Bilgeri | 102/522 |
| 5,578,783 | A | | 11/1996 | Brandeis | |
| 5,677,505 | A | | 10/1997 | Dittrich | |
| 5,712,445 | A | | 1/1998 | Kassuelke et al. | |
| 5,874,691 | A | | 2/1999 | Manole et al. | |
| 5,892,172 | A | | 4/1999 | Candland et al. | |
| 5,955,698 | A | | 9/1999 | Harkins et al. | |
| 5,974,762 | A | | 11/1999 | Rodgers | |
| 6,059,573 | A | | 5/2000 | Patel | |
| 6,123,289 | A | | 9/2000 | Manole et al. | |
| 6,186,072 | B1 | | 2/2001 | Hickerson, Jr. et al. | |
| 6,223,642 | B1 | | 5/2001 | O'Dwyer | |
| 6,357,357 | B1 | | 3/2002 | Glasser | |
| 6,371,030 | B1 | | 4/2002 | Gilman et al. | |
| 6,378,437 | B1 | | 4/2002 | Burke, Jr. et al. | |
| 6,392,213 | B1 | | 5/2002 | Martorana et al. | |
| 6,456,240 | B1 | | 9/2002 | Cesulka | |
| 6,502,528 | B1 | * | 1/2003 | MacLeod et al. | 114/319 |
| 6,575,097 | B1 | | 6/2003 | Nodarse et al. | |
| 6,576,880 | B2 | | 6/2003 | Martorana et al. | |
| 6,626,113 | B1 | | 9/2003 | Gilman et al. | |
| 6,659,013 | B1 | | 12/2003 | Kellner | |
| 6,712,005 | B2 | | 3/2004 | Heitmann | |
| 6,789,454 | B2 | | 9/2004 | Smith | |
| 7,150,218 | B2 | | 12/2006 | Berejnoi et al. | |
| 7,197,984 | B2 | | 4/2007 | Eches | |
| 7,322,268 | B1 | | 1/2008 | Wallin | |
| 7,377,204 | B2 | | 5/2008 | Simmons | |
| 7,549,376 | B1 | * | 6/2009 | Grossman et al. | 102/473 |
| 7,631,601 | B2 | | 12/2009 | Feldman et al. | |
| 7,730,821 | B2 | | 6/2010 | Taylor | |
| 7,795,567 | B2 | | 9/2010 | Schneider | |
| 8,171,838 | B2 | | 5/2012 | Heitmann | |
| 2008/0307994 | A1 | * | 12/2008 | Gustafsson et al. | 102/489 |

OTHER PUBLICATIONS

United States Statutory Invention Registration No. US H1938 H published Feb. 6, 2001.

United States Statutory Invention Registration No. US H401 published Jan. 5, 1988.

United States Statutory Invention Registration No. US H265 published May 5, 1987.

* cited by examiner

SEPARABLE SABOT FOR LAUNCHING PAYLOAD

BACKGROUND OF THE INVENTION

1. Field of the Invention

The invention is in the field of launchable devices that include a sabot, and a payload such as a projectile or missile.

2. Description of the Related Art

Projectiles, such as high density anti-armor darts, have been launched from launchers, such as gun tubes, using sabots. Sabots contain the projectile, for example providing a shape that conforms to a cross-sectional shape of the launcher, and separate from the missile or projectile after launch. Such sabots may also center the projectile in the launcher barrel, and provide an obturator function to retain pressurized gasses behind the sabot during launch.

SUMMARY OF THE INVENTION

A sabot satisfies a collection of desirable operational features: providing environmental protection for a payload; providing protection from damaging in automatic magazines, handling, and/or hoisting; compatibility with crew-served handling, initializing, transport, and ramming; enabling communication between launcher and payload; providing seating in launcher, such as in a barrel of a launcher; providing a ramming brake function; providing a bourrelet function (centering of payload in a launcher); providing an obturator function, such as for chemical guns; preventing tipoff (non-axial divergence) when exiting a launcher; clean separation of petals or panels of the sabot, such as when firing from a howitzer; and/or providing electromagnetic shielding.

According to an aspect of the invention, a sabot includes: panels that when in a closed configuration collectively define and surround a payload space for receiving a payload to be enclosed in the sabot; and a cap having protrusions that slide out of engagement with the panels to release the panels from the closed configuration.

According to another aspect of the invention, a method of launching a payload includes: firing the payload from a launcher with the payload enclosed by a sabot; and after the payload and the sabot exit the launcher, opening panels of the sabot by rotating the panels outward about a base plate of the sabot; and separating the base plate from the payload.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

A sabot is used for enclosing a payload, such as a missile, during launch. The sabot includes a series of panels that are held together prior to launch by engagement with a cap having one or more protrusions or delay pins that maintain the panels in a closed condition. When the launch is initiated, the cap begins to slide out of engagement with the panels. The cap is configured such that the disengagement does not occur immediately upon movement of the cap, but instead the protrusions are sized to delay opening of the panels until the sabot and missile have cleared the launcher. Then the panels rotate outward and drop away from a base the sabot, for example using self-releasing hinges. The base of the sabot may be configured to disengage from the missile (or other payload) by introduction of pressurized gases into a space between the base and an aft end of the missile. The pressurized gases may be pressurized launch gases that are introduced into the space while the sabot is in the launcher, through a one-way valve. In addition the cap may include an inductive coil interface for communication prior to launch, and the sabot may include protective shields that protect the missile and the sabot during loading into the launcher.

Figure 1:
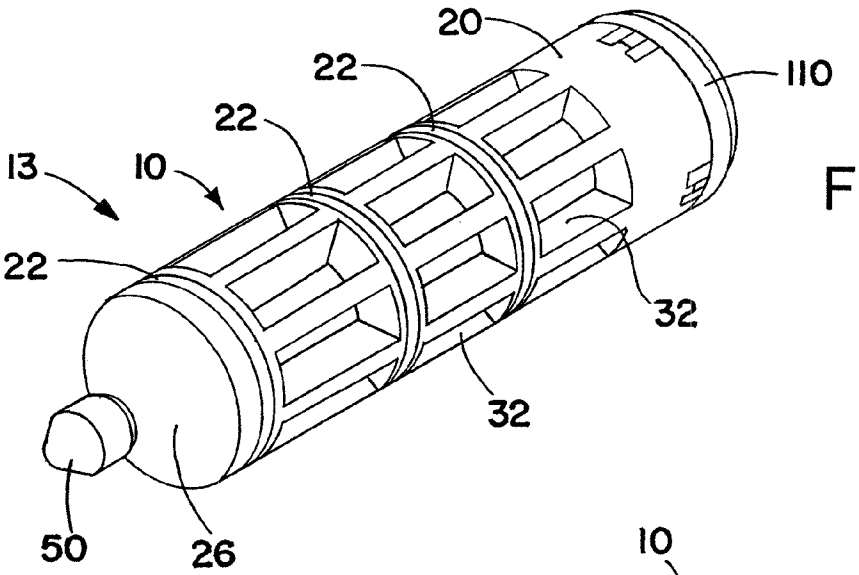
FIG. 1 is an oblique view of a launchable device in accordance with an embodiment of the present invention.
Figure 2:
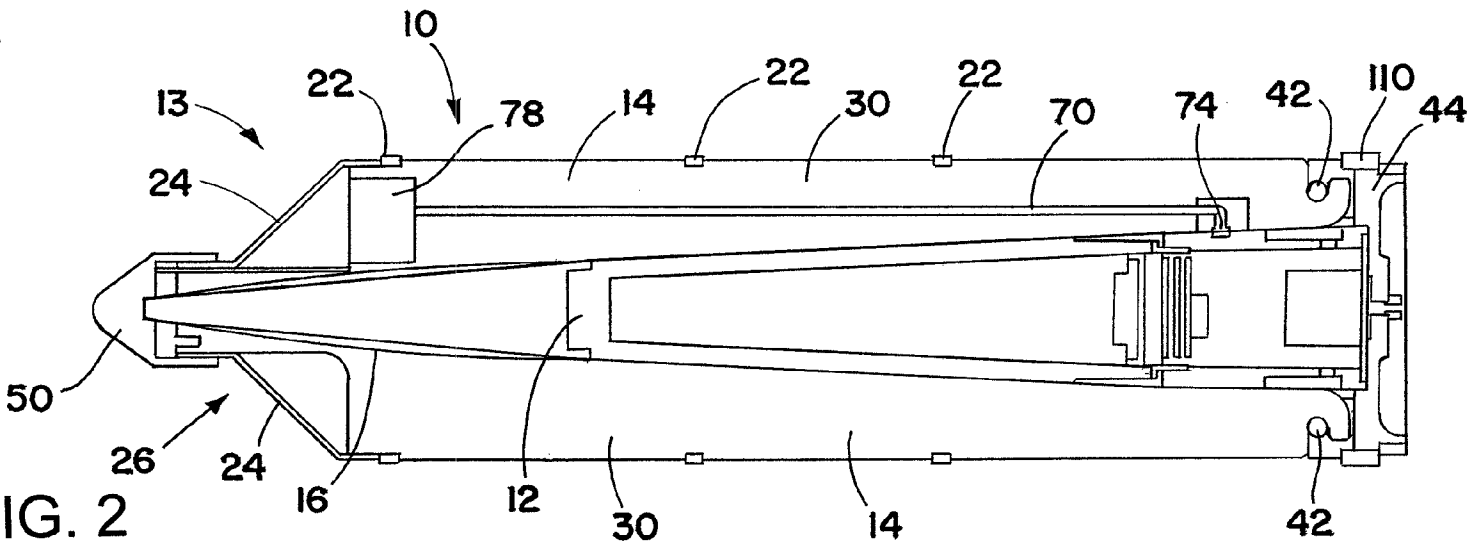
FIG. 2 is a side cross-sectional view of the device of FIG. 1.

FIGS. 1 and 2 show a sabot 10 that is used to enclose a payload such as a projectile (e.g., a guided projectile) or missile 12, with the sabot 10 and the projectile or missile 12 together constituting a launchable device 13. The sabot 10 is configured to protect the projectile or missile 12 during launch and pre-launch transportation and handling, and then separate after launch. The sabot 10 includes a series of panels 14 that in combination define and surround a cavity 16 for receiving the projectile or missile 12. The panels 14 together provide a generally cylindrical outer surface 20 for the sabot 10, with a series of bore riders 22 on the outer surface 20 at different longitudinal (axial) locations along the outer surface 20. The bore riders 20 engage an inner surface of a launcher, to allow smooth sliding of the sabot 10 out of the launcher during launch.

The panels 14 include front shield portions 24 that together constitute a front shield 26 that protects the front of the sabot 10 from damage. For example, the front shield 26 may protect the sabot 10 from damage when the device 13 is loaded into a launcher, such as a gun, such as by being rammed as part of the loading process. The shield 26 may advantageously spread the load that occurs with any collision, for example with a part of the launcher.

Main bodies 30 of the panels 14 may be formed of a lightweight material, for example a composite material, a foam material, or wood. The shield 26 may be a stronger material, for example fiberglass or thin steel. The main bodies 30 may include recesses, such as shown at 32, with material removed in order to save weight.

Figure 4:
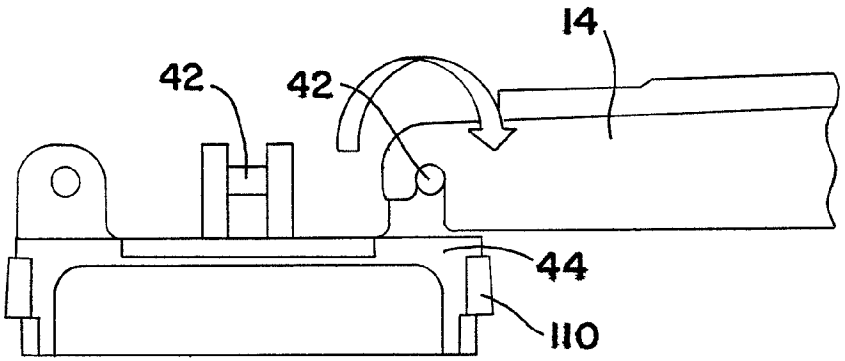
FIG. 4 is another view of the details of FIG. 3, with the panels opened, and able to separate from the base plate.
Figure 3:
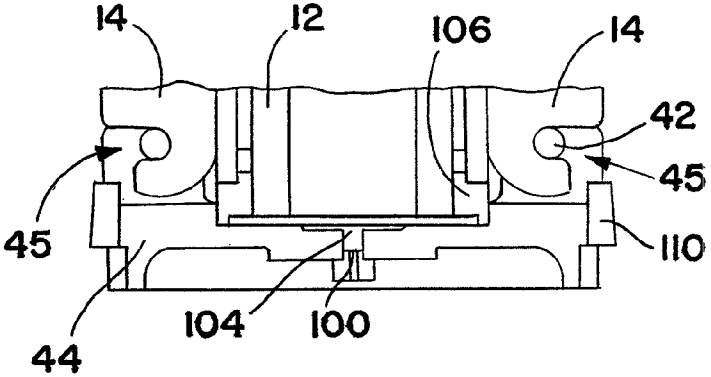
FIG. 3 is a cross-sectional view showing details of the engagement of the sabot panels and base plate of the device of FIG. 1.

The panels 14 are able to pivot at their back (aft) ends, in order to separate from the payload (projectile or missile) 12 after launch, and fall away. Toward that end the panels 14 respective hooks 34 at their aft ends that engage corresponding hinge pins 42 on a base plate 44. The separation of the panels 14 occurs by outward rotation of the panels 14 about the hinge pins 42. The hooks 34 are open hooks, such that when the panels 14 rotated outward by a sufficient amount, the hooks 34 disengage from the hinge pins 42, and the panels 14 fall away from the base plate 44. The engagement of the hooks 34 with the hinge pins 42 acts as self-releasing hinges, as shown in FIGS. 3 and 4. When the panels 14 rotate outward fully, gaps in the hooks 34, such as the gap 45, allow the hinge pins 42 to disengage from the hooks 34, releasing the panels 14 from the base plate 44. The panels 14 fall away from the projectile or missile 12, which continues in flight.

Figure 6:
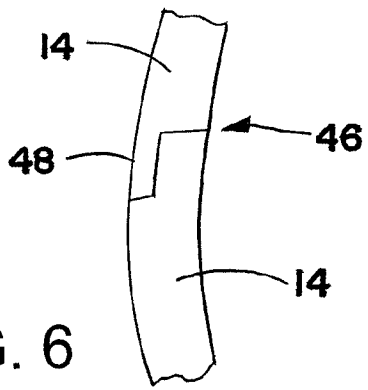
FIG. 6 is an end cross-sectional viewing showing overlapping of the two panels.
Figure 5:
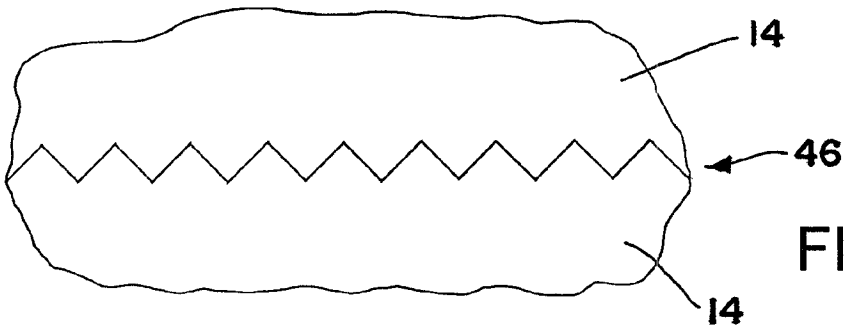
FIG. 5 is a side view showing interlocking of two of the panels of the sabot of FIG. 1.

With reference now in addition to FIGS. 5 and 6, the panels 14 may each have a sliding interlock 46 with adjacent panels, to prevent the panels 14 from sliding relative to one other in an axial direction. The sliding interlock 46, for example a saw-tooth or other interfitting edge shape for the panels 14, may spread any loading on the panels 14, and reduce stresses to parts that engage the panels 14. The panels 14 also may have overlapping edges 48. The interfaces between the panels 14 may be sealed, with an adhesive or other seal, while still allowing the panels 14 to be separated from one another for opening and separation from the base plate 44.

Figure 7:
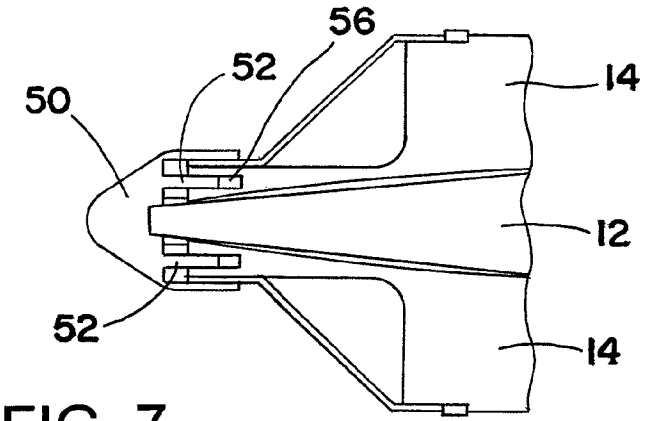
FIG. 7 is a cross-sectional view showing details of the engagement of the cap and sabot panels of the device of FIG. 1.
Figure 8:
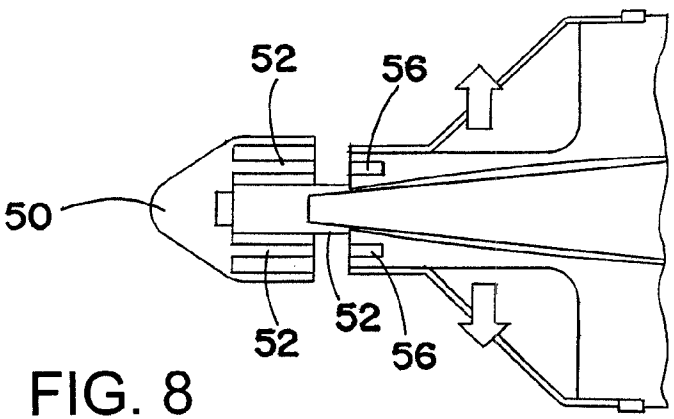
FIG. 8 is another view of the details of FIG. 7, with the cap disengaging from the panels.

A cap 50 engages the front of the panels 14. One of the purposes of the cap 50 is to control the timing of the opening of the panels 14. As shown in FIGS. 7 and 8, the cap 50 has a series of delay pins or protrusions 52 at its back (aft) end. The delay pins 52 engage corresponding recesses 56 at the fronts of the main bodies 30 of the panels 14. When the delay pins protrusions 52 are located at least partially within the recesses 56, as shown in FIG. 3, the panels 14 are prevented from opening up. Once the delay pins 52 disengage from the recesses 56, as shown in FIG. 4, the panels 14 are free to open outward.

The length of the delay pins 52 may be selected to control the timing of the release of the panels 14. As explained in greater detail below, the initiation of launch causes the cap 50 to begin sliding away from the panels 14, with the delay pins 52 beginning to slide out of the recesses 56. Considering the velocity of the cap 50 relative to the panels 14, and the time needed for the sabot 10 and the projectile or missile 12 to clear the launcher (or a significant part of the launcher, such as a muzzle brake), the length of the delay pins 52 may be selected so the panels 14 are released at about the same time that the launchable device 13 exits the launcher. The delay pins 52 may provide a delay of on the order of the millisecond, so that a muzzle brake is or other part of the launcher is cleared before the panels 14 deploy.

Different of the delay pins 52 may have different lengths, enabling different of the panels 14 to separate at different times. For example, in order to prevent tipoff, the panels are timed to release the opposing panel at near the same time. The overlapping of the panels 14 may be configured to be compatible with the order in which the panels 14 are released.

The delay pins 52 may have any of a variety of suitable shapes. In one embodiment the delay pins 52 have curved cross-section shape that is a portion of an annulus.

Figure 9:
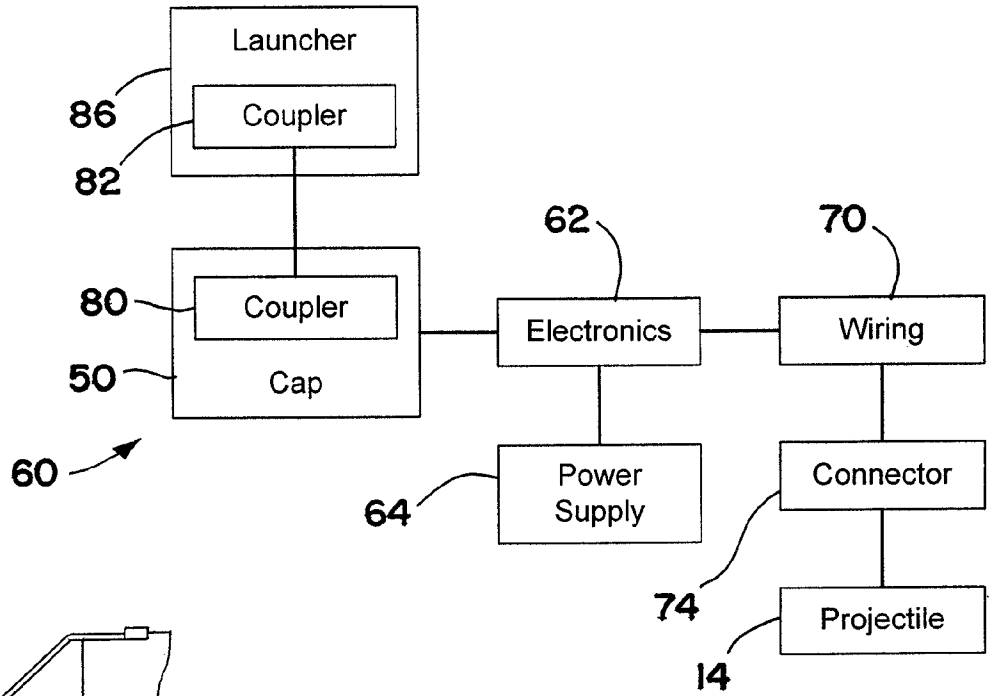
FIG. 9 is a schematic view of a communication system of the device of FIG. 1.

With reference now in addition to FIG. 9, the cap 50 is also part of a communication system 60, for communicating with the launcher and/or a vehicle (such as an aircraft or other air vehicle) or other platform for the launcher. The communication system 60 also includes an electronics package 62 and a power supply 64, as well as a communication harness 70 that is connected to the projectile or missile 12 through a breakaway connector 74. The power supply 64 may be any of a variety of suitable energy storage devices, such as a battery or a supercapacitor. The electronics package 62 and the power supply 64 may be located in a recess 78 in one of the panels 14, and the communication harness 70 and the breakaway connector 74 may be located in the same panel 14. The sabot 10 thus provides a support structure for parts of the communication system 60.

The cap 50 may include an inductive coupler 80 for operatively coupling to a corresponding coupler 82 in the launcher 86. The inductive coupling between the couplers 80 and 82 provides a way to exchange data between the launcher 86 and the launchable device 13, and may also be used to transmit power from the launcher 86 and the launchable device 13. Different types of launchers may use different inductive frequencies for communication and/or power transmission, so the sabot 10 may be configured to receive different caps and/or different electronics packages, for use with different types of launchers. In addition the electronics package 62 may include fire-control information that is particular to one or more types of launchers, providing another possible reason for having the sabot 10 able to handle different electronics packages. Thus the sabot 10 advantageously may be usable with many different types of launchers, with a minimum of reconfiguration required to adapt to different launchers.

The data transmitted from the launcher may include data concerning a fire mission to be accomplished by the projectile or missile 12. Such data may include, for example, data regarding a target location, how the projectile or missile 12 is launched (elevation of the launcher, for example), and/or an altitude for warhead detonation.

The power supply 64 provides energy to keep the electronics 62 for a sufficient time. Projectiles to be fired normally have a time-out period after which any fire mission data is erased, for example to avoid stale mission being used, and to prevent an adversary from downloading the mission from a failed munition. The power supply 64 may be used to provide energy to keep the electronics 62 functioning (e.g., keeping information electronic memories) prior to the expiration of such a time-out period. Signals received at the inductive coupler 80 may be used to power the electronics 62 and/or recharge the power supply 64.

FIG. 3, referred to earlier, shows details of the base plate 44, and its engagement with the aft end of the projectile or missile 12. The base plate 44 includes a check valve 100 that allows gas flow into, but not out of, a space 104 between the base plate 44 and an aft end 106 of the payload 12. During launch of the device 13, some of the pressurized gases behind the device 13, which is used to propel the pressurized gases out of the launcher, enters the space 104, and are captured there. After the device 13 leaves the launcher, the pressure around the device 13 drops to atmospheric pressure. This creates a pressure differential between the high pressure gas captured in the space 104, and the lower pressure gas behind the base plate 44. This pressure differential produces a force on the base plate 44 that separates the base plate 44 from the projectile 12, and pushes the base plate 44 away from the rest of the device 13.

The check valve 100 may consist of one or more hinged or otherwise movable or deformable plates that move, bend, or otherwise reconfigure to allow gas flow into but not out of the base plate space 104. The check valve 100 may be, for example, one or more flaps covering one or more holes in the base plate 44, that allow the hole(s) to be open to receive flow into the space 104, and that close the hole(s) to prevent flow out of the space 104.

The base plate 44 has an obturator 110 around its perimeter. The obturator 110 provides a seal between the launcher and the aft end of the device 13, to retain pressurized gases behind the device 13 during launch of the device 13.

The various parts of the sabot 12 may be made of materials suitable for their purposes. To give examples of suitable material, the base plate 44 may be made of titanium or steel, and the obturator 110 and the bore riders 22 may be made of fiberglas or a suitable metal.

The launch process is initiated by production of pressurized gas in the launcher 86, aft of the device 13. The pressurized gas may be produced by combustion or detonation of suitable chemically-reactive materials. The forward push from the pressurized gas provides an axial impulse to the device 13, a set forward acceleration. In this the device 13 resiliently compresses axially, and then expands again in the axial direction. This axial compression followed by an expansion initiates the sliding of the cap 50 relative to the rest of the sabot 10, beginning the process of disengagement of the cap 50 from the panels 14.

As the device 13 continues moving along the launcher 86, the cap 50 continues to slide relative to the panels 14, bringing the panels 14 closer to release. In addition, pressurized gases fill the space 104 between the base plate 44 and the projectile 12, passing through the check valve 100.

When the device 13 exits from the launcher 86, the panels 14 begins to rotate outward, and the base plate 44 begins to separate from the projectile 12. The panels 14 may rotate outward from aerodynamic forces and/or centrifugal forces.

Finally the sabot 10 fully separates from the projectile 12, with the panels 14 also separating from the base plate 44. The parts of the sabot 10 fall away, while the projectile 12 continues its flight.

The sabot 10 advantageously can be used with different types of payloads, for use in different types of launchers, with the cap 50 and the electronic packages 62 being swapped out as necessary. The separation of the sabot 10 from the projectile 12 can be controlled in a managed manner, in particular to avoid tipoff when exiting the launcher.

Many variations for the illustrated sabot 10 are possible. In the illustrated embodiment the sabot 10 has four panels 14, but alternatively a different number of panels may be employed.

The payload 12 may be a projectile or missile, as in the illustrated embodiment. The projectile or missile 12 may be guidable, for example using control surfaces and/or thrust vectoring to steer the projectile or missile. Alternatively, the sabot 10 may be used for launching other types of devices, for example to launch an unmanned aerial vehicle (UAV), for example from an airplane.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A sabot comprising:

panels that when in a closed configuration collectively define and surround a payload space for receiving a payload to be enclosed in the sabot; and a cap having protrusions that slide out of engagement with the panels to release the panels from the closed configuration;

wherein the cap slides out of engagement by moving in a longitudinal direction of the sabot; and wherein the protrusions are configured to disengage from the panels only after a predetermined movement of the cap relative to the panels, providing a time delay, on the order of a millisecond, between 1) beginning of movement of the cap relative to the panels, and 2) disengagement of the protrusions from the panels.

2. The sabot of claim 1, wherein different of the protrusions have different lengths engaging different of the panels, providing different time delays for release of the different of the panels.

3. The sabot of claim 1, wherein the panels are interlocked to prevent one of the panels sliding relative to the other panels.

4. The sabot of claim 1, wherein the panels overlap one another.

5. The sabot of claim 1, wherein the panels have shield portions that together constitute a forward shield that is stronger than main bodies of the panels, and that protect the main bodies from damage during loading of the sabot into a launcher.

6. The sabot of claim 1, in combination with a payload in the payload space.

7. The combination of claim 6, wherein the payload is a projectile or a missile.

8. The sabot of claim 1, wherein the panels are hingedly coupled to pins of a base plate of the sabot.

9. The sabot of claim 8, wherein the panels have open hooks that engage the pins, such that when the panels have rotated outward relative to the base plate, the hooks disengage the pins, and the panels separate from the base plate.

10. A sabot comprising:

panels that when in a closed configuration collectively define and surround a payload space for receiving a payload to be enclosed in the sabot; and a cap having protrusions that slide out of engagement with the panels to release the panels from the closed configuration;

wherein the panels are hingedly coupled to pins of a base plate of the sabot; and wherein the panels have open hooks that engage the pins, such that when the panels have rotated outward relative to the base plate, the hooks disengage the pins, and the panels separate from the base plate.

11. The sabot of claim 10, wherein the base plate includes a check valve that preferentially allows gas flow into a base plate space between the base plate and the space for receiving the payload.

12. The sabot of claim 10, wherein the cap slides out of engagement by moving in a longitudinal direction of the sabot.

13. A sabot comprising:

panels that when in a closed configuration collectively define and surround a payload space for receiving a payload to be enclosed in the sabot; and a cap having protrusions that slide out of engagement with the panels to release the panels from the closed configuration;

wherein the cap has a coupler for receiving one or more of signals and power from a launcher that the sabot is launched from.

14. The sabot of claim 13, wherein the coupler is an inductive coupler.

15. The sabot of claim 13, wherein the coupler is operatively coupled to the object to be enclosed by the sabot.

16. The sabot of claim 13, wherein the coupler is operatively coupled to electronics and a power supply that are in a recess in one or more of the panels.

17. A method of launching a payload, the method comprising:

firing the payload from a launcher with the payload enclosed by a sabot; and after the payload and the sabot exit the launcher, opening panels of the sabot by rotating the panels outward about a base plate of the sabot; and separating the base plate from the payload;

wherein the rotating the panels outward separates the panels from the base plate, with hooks of the panels separating from pins of the base plate.

18. The method of claim 17, wherein the panels are initially engaged by a cap of the sabot; and wherein after the payload and the sabot exit the launcher the cap slides relative to the panels to release the panels, initiating the opening of the panels.

19. The method of claim 17, wherein the opening the panels includes initiating opening of different of the panels at different times.

20. A method of launching a payload, the method comprising:

firing the payload from a launcher with the payload enclosed by a sabot; and after the payload and the sabot exit the launcher, opening panels of the sabot by rotating the panels outward about a base plate of the sabot; and separating the base plate from the payload;

wherein the separating includes using trapped pressurized gases between the base plate and the payload to separate the base plate from the payload.

* * * * *